US008620189B2

(12) United States Patent
Suzaki et al.

(10) Patent No.: US 8,620,189 B2
(45) Date of Patent: Dec. 31, 2013

(54) DEVELOPING DEVICE AND IMAGE FORMING DEVICE AVOIDING EXCESSIVE DISCHARGE OF DEVELOPER

(75) Inventors: Toshikazu Suzaki, Okazaki (JP); Shunichi Takaya, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 222 days.

(21) Appl. No.: 13/119,268

(22) PCT Filed: Sep. 8, 2009

(86) PCT No.: PCT/JP2009/065663
§ 371 (c)(1),
(2), (4) Date: Mar. 16, 2011

(87) PCT Pub. No.: WO2010/032658
PCT Pub. Date: Mar. 25, 2010

(65) Prior Publication Data

US 2011/0170888 A1 Jul. 14, 2011

(30) Foreign Application Priority Data

Sep. 19, 2008 (JP) ..... 2008-240807

(51) Int. Cl.
*G03G 15/08* (2006.01)

(52) U.S. Cl.
USPC ..... 399/253; 399/254

(58) Field of Classification Search
USPC ..... 399/253, 254, 257, 256, 263, 264, 222, 399/53
See application file for complete search history.

(56) References Cited

U.S. PATENT DOCUMENTS

2006/0239720 A1 10/2006 Hirota et al.

FOREIGN PATENT DOCUMENTS

JP 59-100471 A 6/1984
JP 06230668 A * 8/1994 ..... G03G 15/08

(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued on Apr. 28, 2011, in the corresponding International Application No. PCT/JP2009/065663.
International Search Report (PCT/ISA/210) issued on Nov. 10, 2009, by Japanese Patent Office as the International Searching Authority for International Application No. PCT/JP2009/065663.

(Continued)

*Primary Examiner* — Billy J Lactaoen
(74) *Attorney, Agent, or Firm* — Buchanan Ingersoll & Rooney PC

(57) ABSTRACT

There is provided a developer container, which is divided into a first containing part and a second containing part that are communicated with each other at communication parts on the opposite end sides, which has a discharge port at the second containing part, and in which a developer is contained; a developer carrying member that carries the developer within the developer container to adhere it to the image carrying member; a first conveyance member that conveys the developer in the first containing part of the developer container while agitating it; a second conveyance member that conveys the developer in the second containing part of the developer container while agitating it, and supplies the developer to the developer carrying member; a third conveyance member that is arranged between the second conveyance member and the discharge port; a first driving member that rotary-drives the first conveyance member and the second conveyance member; and a second driving member that drives the third driving member so that its rotation direction can be changed.

13 Claims, 7 Drawing Sheets

(56) References Cited

FOREIGN PATENT DOCUMENTS

| | | | | |
|---|---|---|---|---|
| JP | 8-036297 | A | | 2/1996 |
| JP | 2001-215797 | A | | 8/2001 |
| JP | 2006-293214 | A | | 10/2006 |
| JP | 2006-308689 | A | | 11/2006 |
| JP | 2006343494 | A | * | 12/2006 |

OTHER PUBLICATIONS

Office Action (Notification of Reason for Refusal) dated Nov. 4, 2009, issued in the corresponding Japanese Patent Application No. 2008-240807, and an English Translation thereof.

* cited by examiner

DEVELOPING DEVICE AND IMAGE FORMING DEVICE AVOIDING EXCESSIVE DISCHARGE OF DEVELOPER

This application is based on application No. 2008-240807 filed in Japan on Sep. 19, 2008, the entire content of which is hereby incorporated by reference.

FIELD OF THE INVENTION

The present invention relates to a developing device to be used for an image forming device of an electrophotographic system, and the image forming device using this developing device. Particularly, the present invention relates to a trickle system developing device that supplies a new developer little by little and discharges the deteriorated developer little by little, and the image forming device using this developing device.

DESCRIPTION OF THE RELATED ART

As a developing system used for the image forming device of an electrophotographic system, a developing device of a trickle system has been known, which regulates increase of deteriorated carriers by supplying a new development little by little to the inside of the developing device and discharging the deteriorated charging developer little by little from the developing device (for example, refer to Japanese Patent Application Laid-Open No. 59-100471). This kind of developing device serves to discharge the redundant deteriorated developer by using leveling variation in the developing device to maintain the leveling variation in the developing device approximately constant. Then, according to this kind of developing device, it is possible to maintain a charging ability of the carrier in the developing device approximately constant by exchanging the deteriorated carriers in the developing device with new carriers little by little.

SUMMARY OF THE INVENTION

However, according to the constitution described in Patent Document 1, in the case that an image forming device is placed in inclined manner, the developer exceeding the expected amount is discharged. As a result, the total amount of the developer in the developing device is decreased, an excellent developing is not capable of being obtained, and fades or the like are generated in the image.

Therefore, an object of the present invention is to provide a developing device and an image forming device, which can realize the smooth discharge of the developer while preventing the deterioration of the developer in a developer container and stabilizing the total amount despite the simple and inexpensive constitutions thereof.

In addition, an object of the present invention is to provide a developing device and an image forming device, which can prevent the developer from being excessively discharged in the case that a developing device of a trickle system using a binary developer is inclined.

Means For Solving The Problems

In accordance with one aspect of the present invention, there is provided a developing device including:

a developer container, which is elongated from one end to other end; which is divided into a first containing part and a second containing part that are communicated with each other at communication parts on the opposite end sides; which has a discharge port at one end side of the second containing part; and in which a developer including a toner and a carrier is contained;

a developer carrying member that carries the developer within the developer container to adhere it to the image carrying member;

a first conveyance member that is arranged in the first containing part of the developer container and conveys the contained developer while agitating it;

a second conveyance member that is arranged in the second containing part of the developer container, conveys the contained developer while agitating it, and supplies the developer to the developer carrying member;

a third conveyance member that is arranged between the second conveyance member and the discharge port;

a first driving member that rotary-drives the first conveyance member and the second conveyance member; and a second driving member that drives the third conveyance member so that its rotation direction can be changed.

According to this constitution, it is possible to select the following options, namely, to discharge the developer that is conveyed by the second conveyance member by driving the first driving member from a discharge port by the third conveyance member by driving the second conveyance member; to accumulate this developer; and to return this developer to the inside of the developer container.

In the above aspect, one of the communication parts is arranged in the vicinity of a region where the second conveyance member is close to the third conveyance member.

According to this constitution, it is possible to smooth the flow of the developer from the second conveyance member to the third conveyance member, and the flow of the developer from the second containing part to the first containing part.

In the above aspect, developer amount detecting means that detects a developer amount to be contained in the developer container; and drive controlling means that makes the rotation direction of the third conveyance member into a forward direction being a discharge direction of the developer by controlling driving of the second driving member in the case that the amount of the developer detected by the developer amount detecting means is not less than the upper limit of a reference range; and makes the rotation direction of the third conveyance member into a reverse direction in the case that the detected amount of the developer is not more than the lower limit of the reference range.

According to this constitution, when the total amount of the developer in the developer container is increased, it is possible to discharge the developer in a positive manner by rotating the third conveyance member in a forward direction. In addition, when the total amount of the developer in the developer container is decreased in contrast, it is possible to regulate the discharge amount by rotating the third conveyance member in the reverse direction and allowing the developer to flow reversely. In other words, on the basis of the amount of the developer in the developer container, it is possible to make the discharge amount of the developer into an appropriate value, so that, by stabilizing the total amount of the developer in the developer container, it is possible to regulate a generation cause of the developing unevenness.

In the above aspect, in the case that the developer amount detected by the developer amount detecting means is deviated from the reference range, by controlling driving of the second driving member, the drive controlling means controls the third conveyance member so that, the more the developer amount detected by the developer amount detecting means is deviated from the reference range, the more the rotation speed of the third conveyance member is increased.

According to this constitution, the more the total amount of the developer in the developer container is, the more the developer in the developer container can be discharged positively, and the less the total amount of the developer in the developer container is in contrast, the more the accumulated developer can be allowed to reversely flow to the inside of the developer container by the third conveyance member, so that it becomes possible to early make the total amount of the developer in the developer container into a desired value.

In the above aspect, in the case that the developer amount detected by the developer amount detecting means is within the reference range, the drive controlling means stops the second driving member, discontinues conveyance of the developer by means of the third conveyance member, and allows the third conveyance member to hold the developer.

According to this constitution, it becomes possible to control the unnecessary waste of the developer from the developer container.

In the above aspect, in the case that the developer amount detected by the developer amount detecting means is within the reference range, by driving the second driving member, the drive controlling means makes the rotation direction of the third conveyance member into a forward direction being a discharge direction of the developer to allow the third conveyance member to be rotated at a first set speed; and in the case that the developer amount detected by the developer amount detecting means is not less than the upper limit of the reference range, by controlling and driving the second driving member, the drive controlling means makes the rotation direction of the third conveyance member into a forward direction being a discharge direction of the developer to allow the third conveyance member to be rotated at a second set speed that is faster than the first set speed.

According to this constitution, if the amount of the developer in the developer container is within a reference range, by rotating the third conveyance member in the forward direction, it is possible to discharge the deteriorated developer on a constant basis. Then, if the amount of the developer is not less than the upper limit of the reference range, by positively discharging the developer, it is possible to instantly stabilize the total amount of the developer in the developer container.

In the above aspect, the developing device includes:

inclination detecting means that detects the inclination of said developer container;

drive controlling means that makes the rotation direction of said third conveyance member into a forward direction being a discharge direction of the developer to allow said third conveyance member to be rotated at a first set speed by driving said second driving member in the case that the inclination angle detected by said inclination detecting means is within the reference range; that makes the rotation direction of said third conveyance member into a forward direction being a discharge direction of the developer to allow said third conveyance member to be rotated at a second set speed that is faster than said first set speed by driving said second driving member in the case that the inclination angle detected by said inclination detecting means is not less than the upper limit of the reference range with an end portion on which the discharge port is formed located on the upper side; and that makes the rotation direction of said third conveyance member into a reverse direction in the case that the detected developer amount is not more than the lower limit of the reference range with an end portion on which the discharge port is formed located on the lower side.

According to this constitution, even when the developer container is arranged in inclined manner depending on a difference of the installation condition, by adjusting the rotation speed of the third conveyance member and by inversely rotating the third conveyance member, it is possible to stabilize the total amount of the developer in the developer container.

As means adapted to solve the problems, according to the present invention, the image forming device is formed by the constitution being provided with a developing device with any of the above-described constitutions.

Effect of the Invention

According to the present invention, since the third conveyance member is driven separately from the first and second conveyance members for agitating and conveying the developer in the developer container, it is possible to discharge the developer in response to the state of the developer in the developer container, accumulate the developer in the third conveyance member, or allow the developer to reversely flow into the developer container. As a result, the total amount of the developer in the developer container can be stabilized on a constant basis, so that it is possible to obtain favorable image forming processing.

BEST MODE FOR CARRYING OUT THE INVENTION

Hereinafter, the embedment(s) according to the present invention will be described with reference to the drawings. Further, in the following explanation, as necessary, the terms showing specific directions and positions (for example, "above", "below", "side", "end", and other terms including these terms) are used; however, these terms are used in order to make the understanding of the invention with reference to the drawings easy and due to meanings of these terms, the technical scope of the present invention is not limited.

Figure 1:
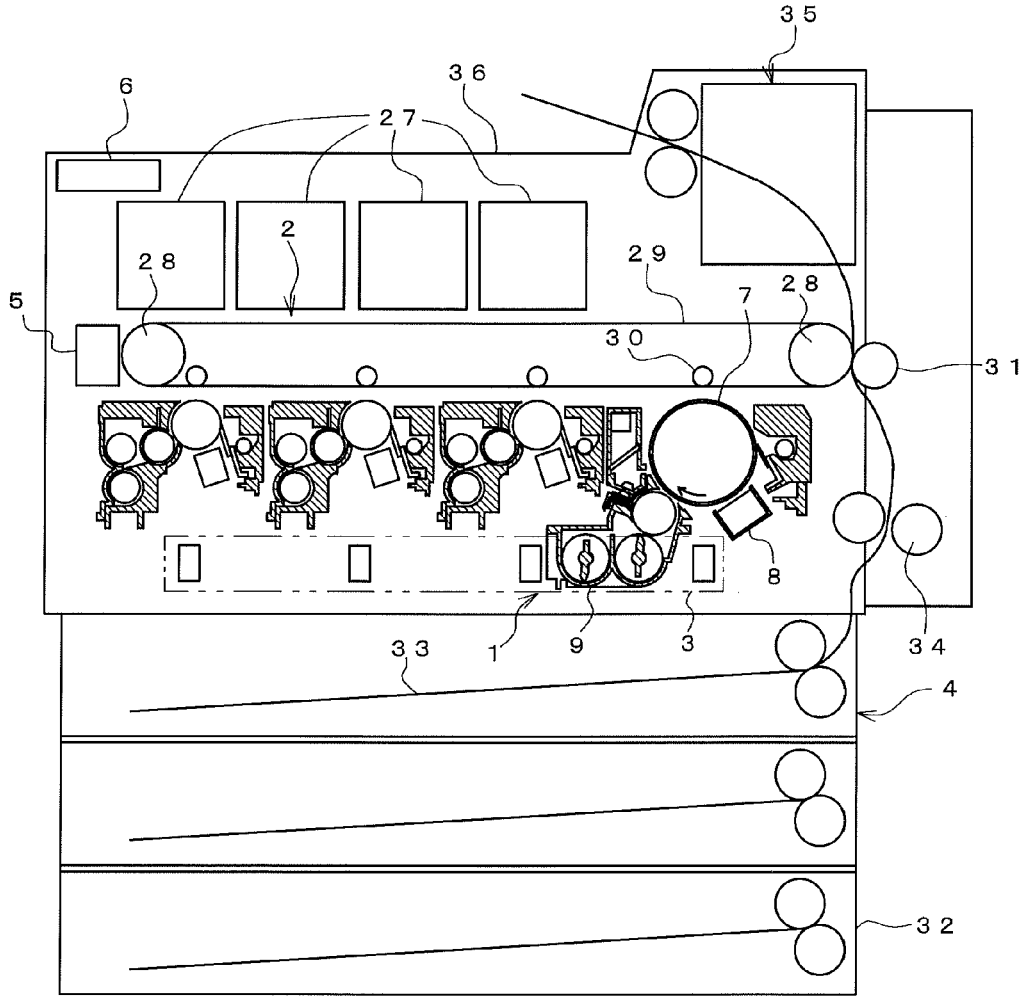
FIG. 1 is a front view showing the outline of an image forming device according to the present embodiment.
Figure 6:
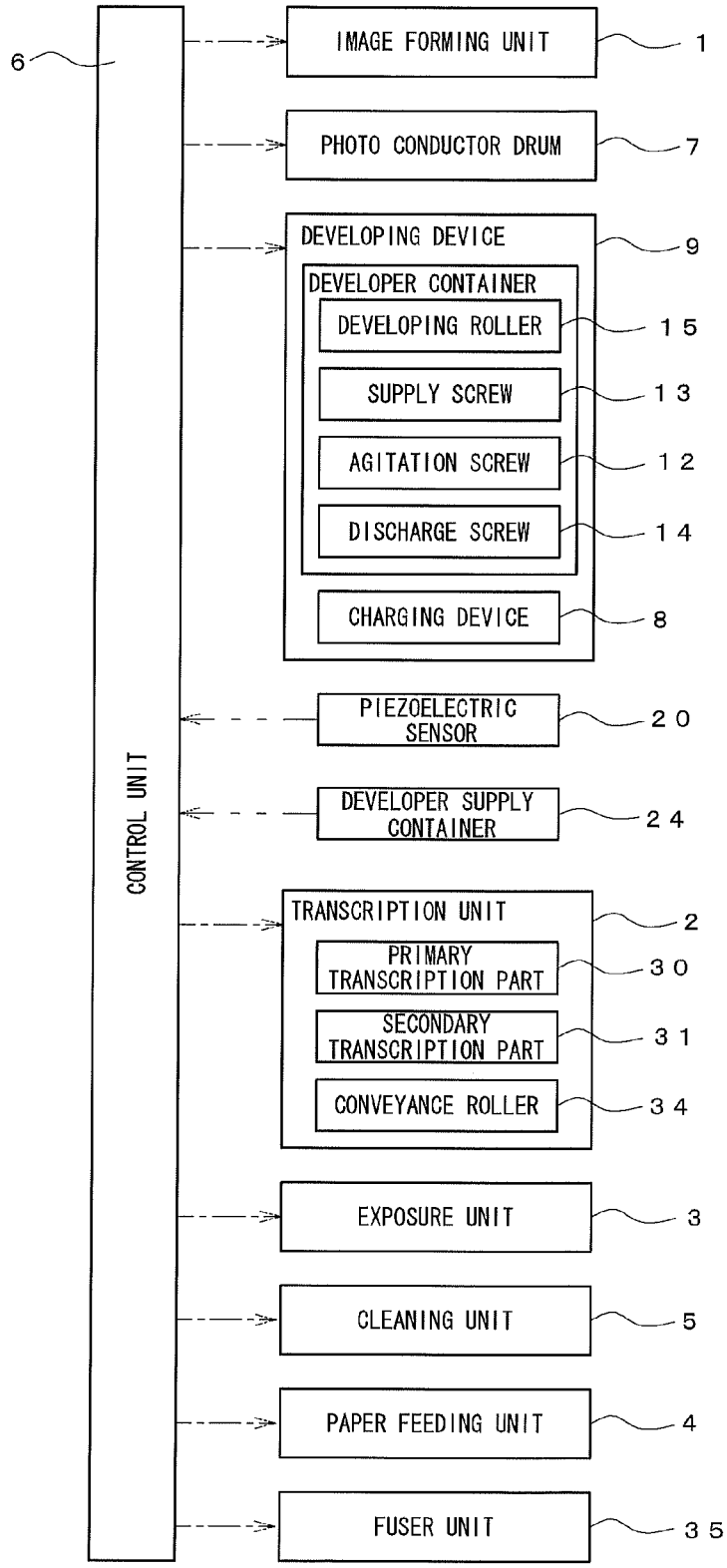
FIG. 6 is a block diagram of the image forming device according to the present embodiment.

Among image forming devices of an electrophotographic system using a binary developer, FIG. 1 particularly illustrates an image forming device of a so-called trickle system that supplies not only toner but also a developer. This image forming device is largely provided with an image forming units 1, a transcription unit 2, an exposure unit 3, a paper feeding unit 4, a cleaning unit 5, and a control unit 6 (refer to FIG. 6) or the like.

Figure 2:
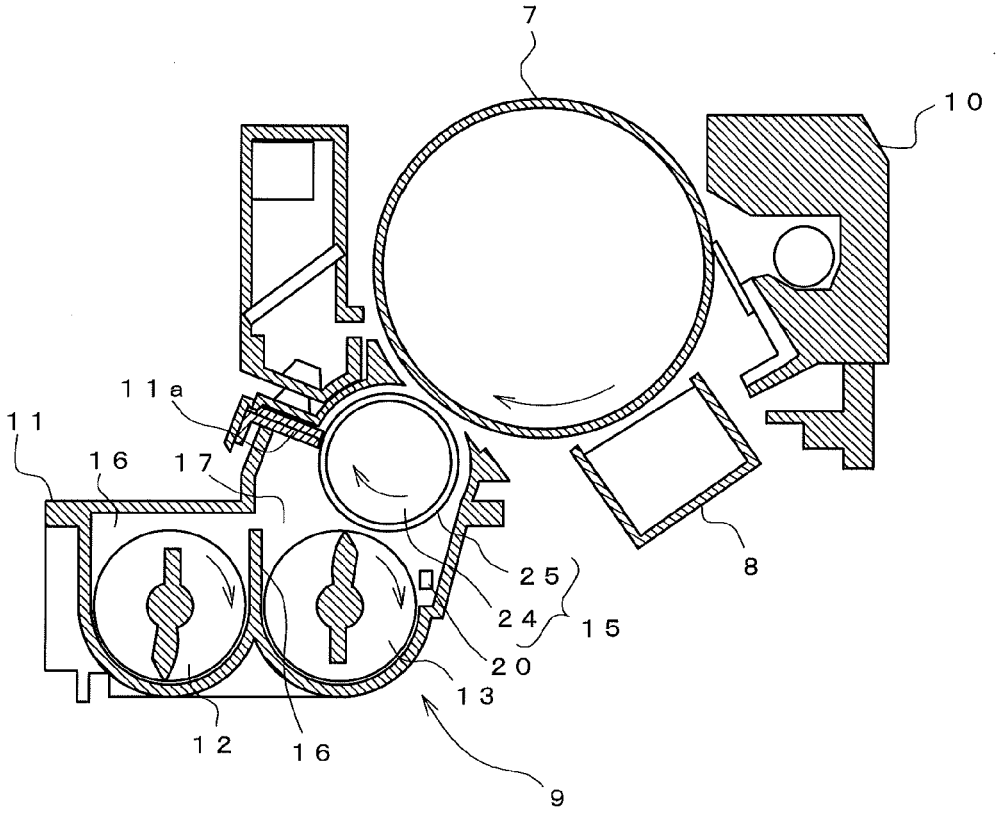
FIG. 2 is a front sectional view showing the outline of a developing device of FIG. 1.

The image forming units 1 are arranged on four places along the intermediate transcription belt 29 of the transcription unit 2, and by forming images of yellow (Y), magenta (M), cyan (C), and black (Bk), from the left side, respectively, the image forming units 1 form color images on the surface of the intermediate transcription belt 29. As shown in FIG. 2, respective image forming units 1 are provided with a charging device 8, a developing device 9, and a cleaning device 10 or the like around a photo conductor drum 7.

The charging device 8 forms a predetermined surface potential on the surface of the photo conductor drum 7. This surface potential is made into an electrostatic latent image when the surface of the photo conductor drum 7 is exposed by the exposure unit 3.

Figure 3:
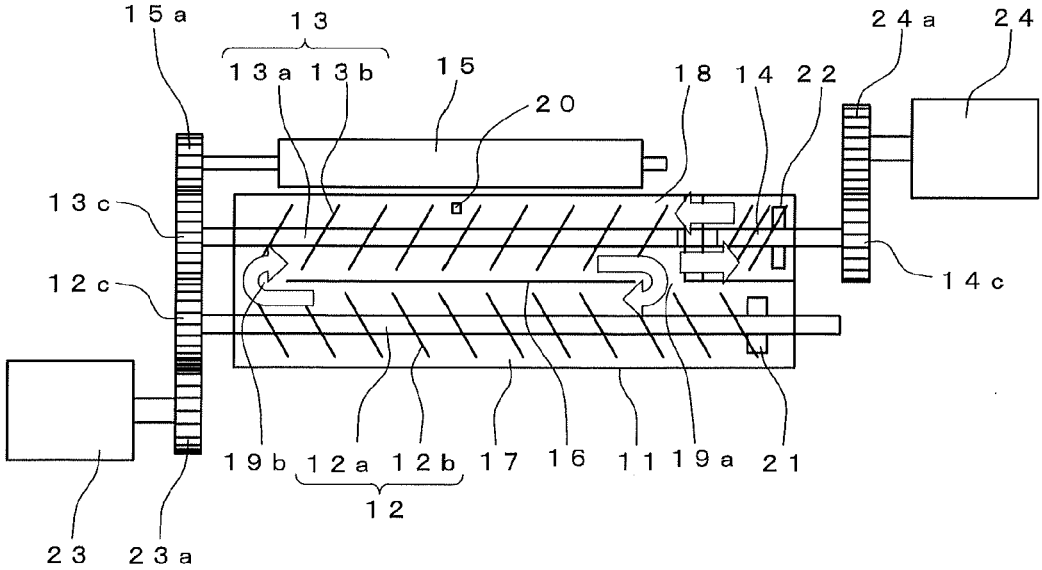
FIG. 3 is a sectional view showing a developer container of FIG. 2.

As shown in FIG. 2 and FIG. 3, the developing device 9 has an agitation screw 12 that is a first conveyance member, a supply screw 13 that is a second conveyance member, a discharge screw 14 that is a third conveyance member, and a developing roller 15, which are respectively contained in a developer container 11.

As shown in FIG. 3, the developer container 11 is formed as a long box that is elongated from one end to other end, and the developer container 11 is divided into two parts, namely, a first containing part 17 and a second containing part 18 along a longitudinal direction by a partition wall 16. However, the opposite end sides of the first containing part 17 and the second containing part 18 are communicated with each other by communication parts 19*a* and 19*b*, and the contained developer is cyclically moved, being agitated.

In the developer container 11, in the vicinity of the discharge screw 14, a piezoelectric sensor 20 as developer amount detecting means (refer to FIG. 6) is provided. In response to the pressure from the developer contained in the developer container 11, this piezoelectric sensor 20 converts this pressure into an electric signal to detect a fluid level of the developer by the control unit 6 to be described later.

A developer supply port 21 is formed on one end side of the first containing part 17, and as described later, the developer is supplied from a corresponding developer supply container 27. Here, as the developer, a binary developer containing toner and a carrier is used. However, the developer may further contain an external addition agent or the like.

On the other hand, a developer discharge port 22 is formed on one end side of the second containing part 18 so as to prevent a carrier that is deteriorated from remaining in the developer container 11 over a long period by appropriately discharging the developer.

The agitation screw 12 is structured being provided with a spiral wing 12*b* around a rotation shaft 12*a* to be arranged in the first containing part 17. The agitation screw 12 is rotary-driven to agitate the developer, conveying the developer from one end side to other end side.

The supply screw 13 is arranged in the second containing part 18 having a spiral wing 13*b* placed around a rotation shaft 13*a* as well as the above-described agitation screw 12. The supply screw 13 is rotary-driven to transport the developer from the side of the communication parts 19*b* to the side of the communication part 19*a* and supplies the developer to the developing roller 15.

The agitation screw 12 and the supply screw 13 are rotary-driven in synchronization in such a manner that gears 12*c* and 13*c* respectively provided on the rotation shafts 12*a* and 13*a*, which are protruded from one end side, are engaged with each other, and a driving force is transferred to the agitation screw 12 and the supply screw 13 via a gear 23*a*, which is provided to the rotation shaft of a first motor 23 being a first driving member.

Figure 4:
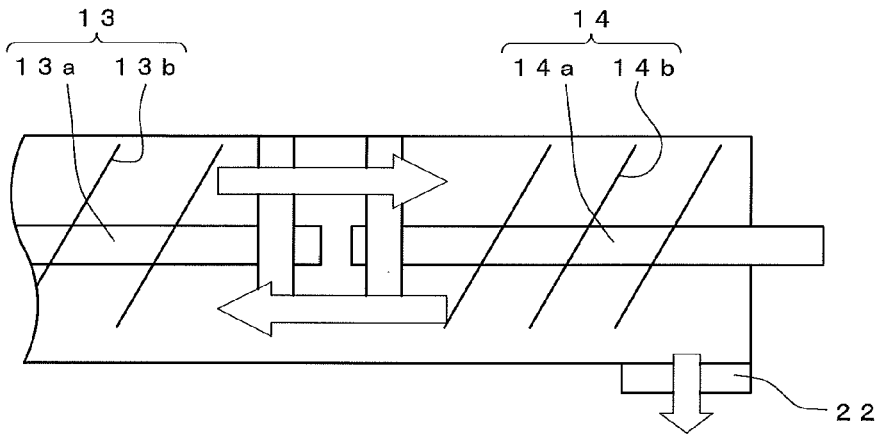
FIG. 4 is a partial enlarged view of FIG. 3.
Figure 5:
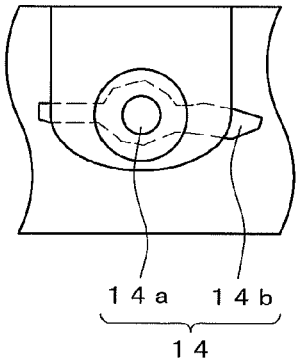
FIG. 5 is a side view of a discharge screw of FIG. 4.

As shown in FIG. 3 and FIG. 4, the discharge screw 14 is structured being provided with a spiral wing 14*b* around a rotation shaft 14*a*. Then, this discharge screw 14 is driven being rotated forward and reversely in such a manner that the driving force from a second motor 24, which is a second driving member separately provided from the first motor 23 for driving the agitation screw 12 and the supply screw 13, is transported from the gear 24*a* to the discharge screw 14 via a gear 14*c*, which is placed on the rotation shaft 14*a*.

As shown in FIG. 2, the developing roller 15 has a plurality of permanent magnets 26 in the cylindrical sleeve 25 (here, five permanent magnets S2, N2, S1, N1, and S3 are arranged in this order in a clockwise direction). The sleeve 25 is structured so as to be rotated in an arrow direction in the drawing by sleeve driving means (not illustrated).

As shown in FIG. 1, the developer supply container 27 for supplying a binary developer for supply composed of toner and a carrier (hereinafter, merely described as a developer) is detachably located above the developing device 9.

As shown in FIG. 2, after transcription of the toner to the surface of the photo conductor drum 7, collecting the toner remaining on this surface, the cleaning device 10 cleans this surface.

The transcription unit 2 is structured in such a manner that the intermediate transcription belt 29 is built between a pair of support rollers 28, and driving the support rollers 28 by means of driving means (not illustrated), the intermediate transcription belt 29 is cyclically moved in an arrow direction. The transcription unit 2 is provided with a primary transcription part 30 and a secondary transcription part 31.

The exposure unit 3 irradiates a laser beam to the above-described photo conductor drum 7 to form an electrostatic latent image corresponding to the image data that is read by a scanner (not illustrated).

The paper feeding unit 4 conveys recording medium 33 contained in a cassette 32 to the secondary transcription part 31 in series via a conveyance roller 34. A toner image is transcribed to the recording medium 33 that is conveyed to the secondary transcription part 31, and after the toner image transcribed by a fuser unit 35 is fixed, the recording medium 33 is conveyed to a discharge tray 36.

The cleaning unit 5 is capable of coming contact with and being detached from the intermediate transcription belt 29 and the cleaning unit 5 collects the remaining toner on the surface of the intermediate transcription belt 29 when the cleaning unit 5 gets close to the intermediate transcription belt 29.

The control unit 6 controls driving of the discharge screw 14 or the like in the developing device 9 on the basis of the input signals from the piezoelectric sensor 20 or the like as described later.

(Operation)

Next, the operation of the image forming device that is formed by the above-described constitution will be described.

The color print data that is obtained by reading the image, or the image data that is outputted from a personal computer or the like is transmitted to each of the image forming units 1 as an image signal of each color, yellow (Y), magenta (M), cyan (C), and black (Bk) after being applied with predetermined signal processing.

Respective image forming units 1 form latent images by projecting the laser beam that is modulated by image signals on the photo conductor drum 7. Then, respective image forming units 1 supply the toner from the developing device 9 to the photo conductor drum 7.

As described later, by rotary-driving the agitation screw 12, the supply screw 13, and the discharge screw 14, the developing device 9 circulates the developer contained in the developer container 11 while agitating and circulating the developer, and the developing device 9 appropriately discards the developer. In addition, supplying the toner from the supply screw 13 to the developing roller 15 and scraping out the toner by a regulation member 11*a*, the constant amount of the tonner is obtained. After that, the developing device 9 conveys the tonner to the photo conductor drum 7.

Thereby, on respective photo conductor drums 7, tonner images of yellow, magenta, cyan, and black are formed. The formed yellow, magenta, cyan, and black tonner images are primarily transcribed by the primary transcription part 30 being superimposed on the moving intermediate transcription belt 29 in series. Thus, the superimposed toner images that are formed on the intermediate transcription belt 29 are moved to the secondary transcription part 31 in accordance with movement of the intermediate transcription belt 29.

In addition, the recording medium 33 is supplied from the paper feeding unit 4. The supplied recording medium 33 is conveyed between the secondary transcription part 31 and the intermediate transcription belt 29 by the conveyance roller 34, and then, the toner images formed on the intermediate transcription belt 29 are transcribed on this recording medium 33. The recording medium 33 having the toner images transcribed is further conveyed to a fuser device, and after the transcribed toner images are fixed there, the recording medium 33 is discharged to the discharge tray 36.

In the meantime, the developing device 9 controls driving of the agitation screw 12, the supply screw 13, and the discharge screw 14 on the basis of detection signals from the piezoelectric sensor 20. In the following explanation, only drive control of the discharge screw 14, which is a characteristic part of the present invention, will be referred to.

Figure 7:
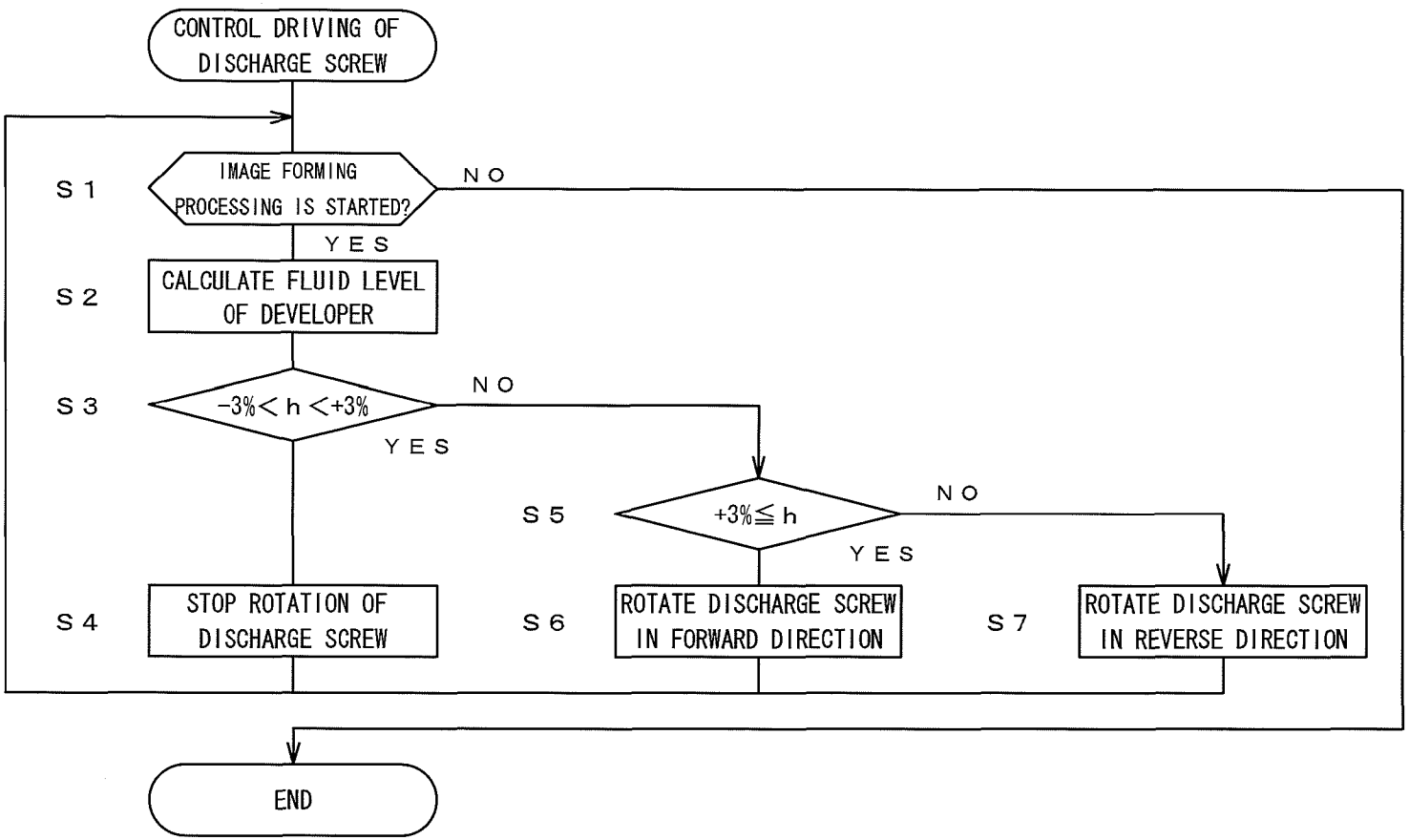
FIG. 7 is a flow chart showing the drive control of the discharge screw according to the present embodiment.

In other words, as shown in flowchart of FIG. 7, when the image forming processing is started (step S1), on the basis of a detection voltage that is inputted from the piezoelectric sensor 20, a fluid level of the developer in the developer container 11 is calculated (step S2). Then, it is judged whether or not the calculated fluid level is covered in the range of −3% to +3% of a set range (here, a range from the reference fluid level to a point where the fluid level can be displaced (the range of 0 to full) (step S3). If the fluid level is within the set range, the rotation of the discharge screw 14 is stopped (step S4). Thereby, the developer is accumulated in the region where the discharge screw 14 is located, and discharge of the developer from the developer discharge port 22 is regulated. It is obvious that the developer that cannot be completely accumulated is discharged via the developer discharge port 22.

In addition, the calculated fluid level is deviated from the set range and is not less than the upper limit of the set range (step S5: YES), the discharge screw 14 is rotated in a forward direction (step S6). In this case, it is preferable that the rotation speed of the discharge screw 14 is adjusted so that, the higher the fluid level is, the more this rotation speed is increased. Thereby, the developer is conveyed in a direction shown by a right-pointing arrow in FIG. 3 and FIG. 4, and this makes it possible to rapidly decrease the developer amount in the developer container 11 to the reference amount. Then, it becomes possible to carry out the image forming processing in an appropriate state.

In addition, the calculated fluid level is deviated from the set range and is not more than the lower limit of the set range (step S5: NO), the discharge screw 14 is rotated in a reverse direction (step S7). In this case, it is preferable that the rotation speed of the discharge screw 14 is adjusted so that, the lower the fluid level is, the more this rotation speed is increased. Thereby, as shown by a left-pointing arrow in FIG. 3 and FIG. 4, it is possible to return the amount accumulated in the discharge screw 14 to the inside of the developer container 11, so that, without supplying the developer from the developer supply container 27, it becomes possible to stabilize the amount of the developer. In addition, in the case that it is not enough to return the accumulated developer by rotating the discharge screw 14 in the reverse direction, the developer may be supplied from the developer supply container 27. Thereby, it becomes possible to appropriately prevent the developer from being consumed wastefully. Further, the tonner density in the developer within the developer container 11 is controlled so as to be made constant by supplying the developer from the developer supply container 27; however, this density control itself is not directly related to the present invention, so that the explanation thereof is herein omitted.

The drive control of the above-described respective screws may be carried out as follows. However, in the following explanation, the identical processing is provided with the corresponding step numbers and the explanation thereof is herein omitted.

Figure 8:
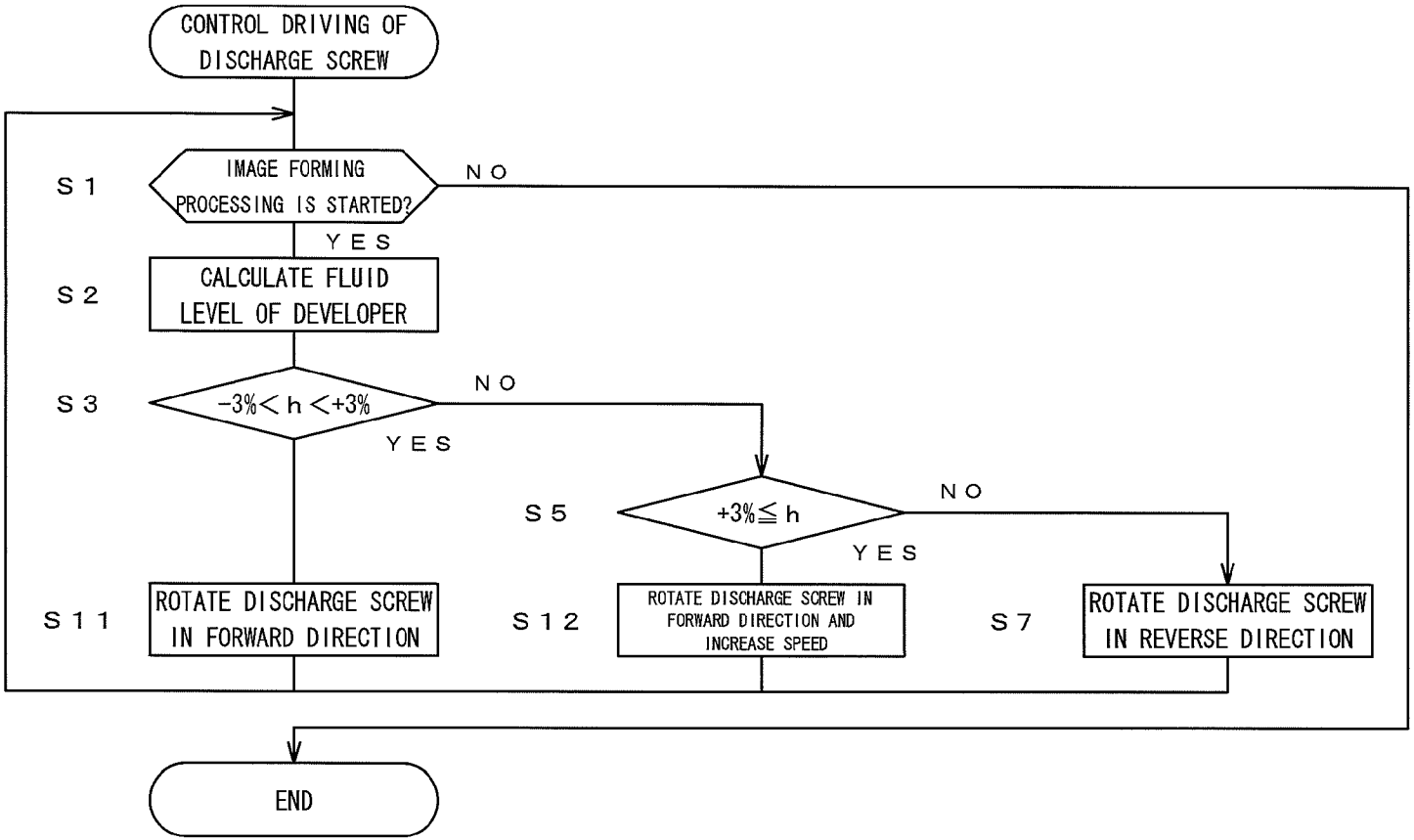
FIG. 8 is a flow chart showing the drive control of the discharge screw according to other embodiment.

In other words, as shown in a flowchart of FIG. 8, when the fluid level is within the set range, instead of stopping the discharge screw 14, discharge screw 14 is rotated in the forward direction (step S11). Then, if the fluid level becomes not less than the upper limit, the rotation speed of the discharge screw 14 in the forward direction is increased compared to the case of the above-described step S11 (step S12). As a result, even if the fluid level is within the set range, the developer is discharged by the discharge screw 14. Therefore, the deteriorated carrier is hardly accumulated in the developer container 11, and it becomes possible to stabilize the state of the image forming processing on a constant basis.

(Other Embodiment(s))

Further, the present invention is not limited to the constitution that is described in the above-described embodiment, and various modifications can be made.

According to the above-described embodiment, the fluid level of the developer is detected by providing the piezoelectric sensor 20 in the developer container 11; however, it is also possible to provide other detecting means such as an inclination sensor and a weight sensor so as to stabilize the total amount of the developer in the developer container 11.

Figure 9:
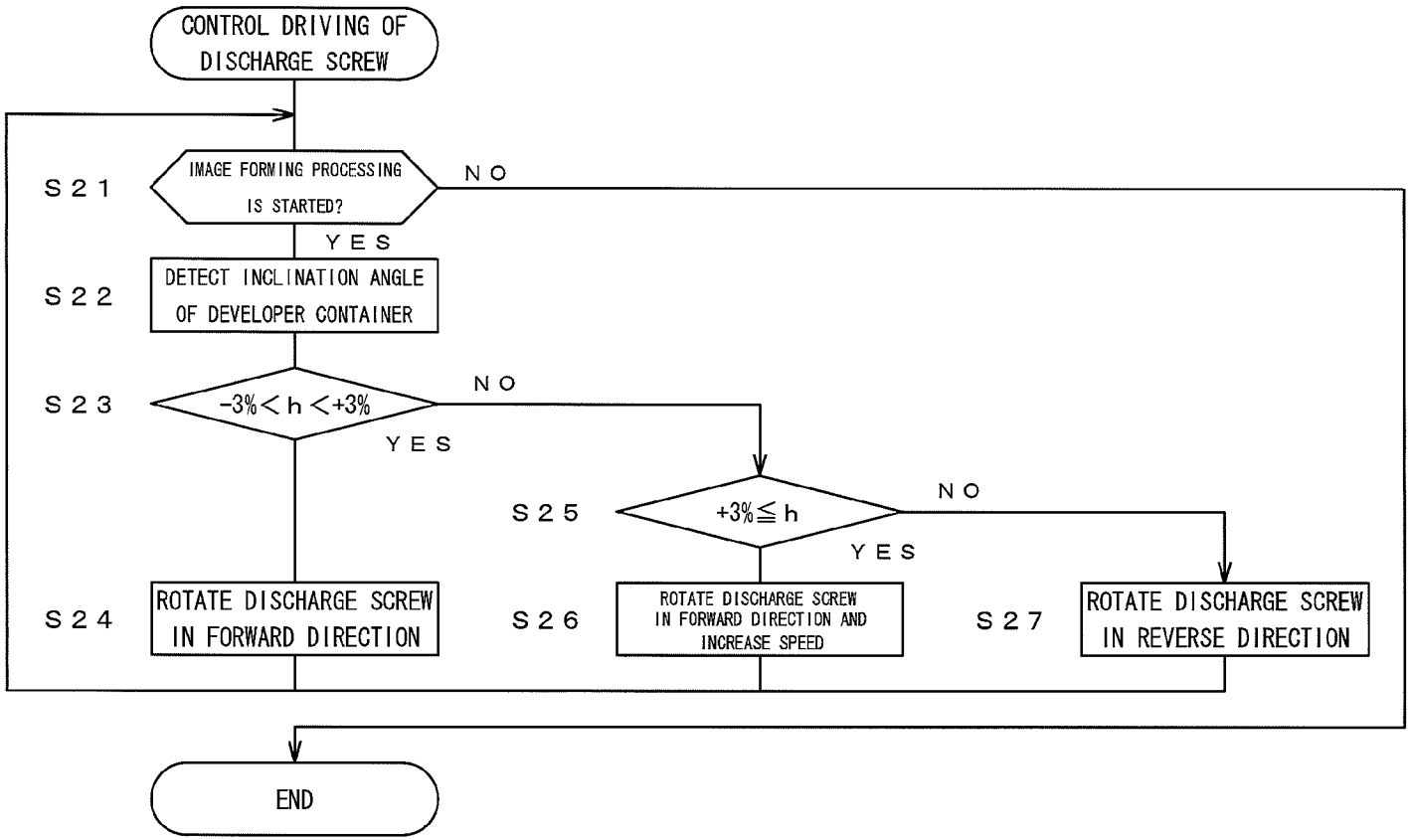
FIG. 9 is a flow chart showing the drive control of the discharge screw according to other embodiment.

In the case of using the inclination sensor, the inclination angle of the developer container 11 in a longitudinal direction with respect to the horizontal surface of the developer container 11 is detected, and on the basis of this detection result, in accordance with the flowchart of FIG. 9, driving of the discharge screw 14 is controlled.

In other words, when the image forming processing is started (step S21), on the basis of a detection signal detected by the inclination sensor, the inclination angle of the developer container 11 is calculated (step S22). Then, it is judged whether or not the calculated inclination angle X of the developer container 11 is within a set range ($-3° < X < +3°$) (step S23). If the inclination angle of the developer container 11 is within the set range, it is judged that the developer contained in the developer container 11 is not biased, the flow of the developer is smooth, and the image forming processing can be appropriately carried out. Then, the discharge screw 14 is rotated in the forward direction at a first set speed (step S24). Further, as the first set speed, a value is used, which is capable of supplying the developer containing the tonner amount being equivalent to the consumption amount.

In the case that the inclination angle of the developer container 11 is not less than an set upper limit (+3°) (step S25: YES), namely, in the case that the side of the developer discharge port of the developer container 11 is elevated to be inclined not less than 3° with respect to the horizontal surface, the rotation speed of the discharge screw 14 in the forward direction is made into a second set speed, which is faster than the above-described first set speed (step S26). Thereby, the side of the developer discharge port is elevated, and the discharge of the developer is not made. As a result, it is possible to avoid a defect such that the total amount of the developer contained in the developer container 11 is increased more than needs.

On the other hand, if the inclination angle of the developer container 11 is not more than a set lower value (−3°) (step S5: NO), namely, if the side of the developer discharge port of the developer container 11 is lowered to be inclined not less than 3° with respect to the horizontal surface, the rotation direction of the discharge screw 14 is changed to the reverse direction (step S27). Thereby, it is possible to avoid a defect such that the large amount of the developer that is biased due to lowering of the side of the developer discharge port is discharged and, as a result, the total amount of the developer contained in the developer container 11 is too decreased. Further, the redundant developer is discharged climbing over the reversely-rotating discharge screw 14.

Thus, driving of the discharge screw 14 is controlled on the basis of the detection signal from the inclination sensor. Therefore, even if the developer container 11 is inclined due to a difference in the installation place of the image forming device and the fixing state of the developer container 11, it is possible to regulate the total amount of the developer in the developer container 11 so as to be made into a constant value .

In addition, in the case of calculating the weight sensor, calculating the total weight of the developer to be contained from the weight of the developer container 11, the forward and reverse rotation of the discharge screw 14 and the driving of the discharge screw 14 may be controlled so that the calculated total weight of the developer is maintained within the set range.

The invention claimed is:

1. A developing device, comprising:

a developer container, which is elongated from one end to other end; which is divided into a first containing part and a second containing part that are communicated with each other at communication parts on the opposite end sides; which has a discharge port at one end side of the second containing part; and in which a developer including a toner and a carrier is contained;

a developer carrying member that carries the developer within said developer container to adhere it to an image carrying member;

a first conveyance member that is arranged in the first containing part of said developer container and conveys the contained developer while agitating it;

a second conveyance member that is arranged in the second containing part of said developer container, conveys the contained developer while agitating it, and supplies the developer to said developer carrying member;

a third conveyance member that is arranged between said second conveyance member and said discharge port;

a first driving member that rotary-drives said first conveyance member and said second conveyance member; and a second driving member that drives said third conveyance member so that its rotation can be changed from a forward direction being a discharge direction of the developer to a reverse direction, and so that its rotation can be stopped, wherein one of said communication parts is arranged in the vicinity of a region where said second conveyance member is close to said third conveyance member, and said second driving member drives said third conveyance member in the reverse direction so that the developer accumulated in said third conveyance member is returned to said one of said communication parts inside the developer container when the amount of developer in the developer container is less than a lower limit of a predetermined range, and stops rotation of said third conveyance member when the amount of developer in the developing container is within a predetermined range.

2. A developing device comprising:

a developer container, which is elongated from one end to other end; which is divided into a first containing part and a second containing part that are communicated with each other at communication parts on the opposite end sides; which has a discharge port at one end side of the second containing part; and in which a developer including a toner and a carrier is contained;

a developer carrying member that carries the developer within said developer container to adhere it to an image carrying member;

a first conveyance member that is arranged in the first containing part of said developer container and conveys the contained developer while agitating it;

a second conveyance member that is arranged in the second containing part of said developer container, conveys the contained developer while agitating it, and supplies the developer to said developer carrying member;

a third conveyance member that is arranged between said second conveyance member and said discharge port;

a first driving member that rotary-drives said first conveyance member and said second conveyance member;

a second driving member that drives said third conveyance member so that its rotation direction can be changed;

developer amount detecting means that detects a developer amount to be contained in said developer container; and drive controlling means that makes the rotation direction of said third conveyance member into a forward direction being a discharge direction of the developer by controlling driving of said second driving member in the case that the amount of the developer in said developer container detected by said developer amount detecting means is not less than the upper limit of a reference range; and makes the rotation direction of said third conveyance member into a reverse direction so that the developer accumulated in said third conveyance member is returned to one of said communication parts inside the developer container in the case that the detected amount of the developer in said developer container is not more than the lower limit of the reference range.

3. The developing device according to claim 2, wherein in the case that the developer amount detected by said developer amount detecting means is deviated from the reference range, by controlling driving of said second driving member, said drive controlling means controls said third conveyance member so that, the more the developer amount detected by said developer amount detecting means is deviated from the reference range, the more the rotation speed of said third conveyance member is increased.

4. The developing device according to claim 2, wherein in the case that the developer amount detected by said developer amount detecting means is within the reference range, said drive controlling means stops said second driving member, discontinues conveyance of the developer by means of said third conveyance member, and allows said third conveyance member to hold the developer.

5. The developing device according to claim 2, wherein in the case that the developer amount detected by said developer amount detecting means is within the reference range, by driving said second driving member, said drive controlling means makes the rotation direction of said third conveyance member into a forward direction being a discharge direction of the developer to allow said third conveyance member to be rotated at a first set speed; and in the case that the developer amount detected by said developer amount detecting means is not less than the upper limit of the reference range, by controlling and driving said second driving member, said drive controlling means makes the rotation direction of said third conveyance member into a forward direction being a discharge direction of the developer to allow said third conveyance member to be rotated at a second set speed that is faster than said first set speed.

6. A developing device comprising:

a developer container, which is elongated from one end to other end; which is divided into a first containing part and a second containing part that are communicated with each other at communication parts on the opposite end sides; which has a discharge port at one end side of the second containing part; and in which a developer including a toner and a carrier is contained;

a developer carrying member that carries the developer within said developer container to adhere it to an image carrying member;

a first conveyance member that is arranged in the first containing part of said developer container and conveys the contained developer while agitating it;

a second conveyance member that is arranged in the second containing part of said developer container, conveys the contained developer while agitating it, and supplies the developer to said developer carrying member;

a third conveyance member that is arranged between said second conveyance member and said discharge port;

a first driving member that rotary-drives said first conveyance member and said second conveyance member;

a second driving member that drives said third conveyance member so that its rotation direction can be changed;

inclination detecting means that detects the inclination of said developer container; and drive controlling means that makes the rotation direction of said third conveyance member into a forward direction being a discharge direction of the developer to allow said third conveyance member to be rotated at a first set speed by driving said second driving member in the case that the inclination angle detected by said inclination detecting means is within the reference range; that makes the rotation direction of said third conveyance member into a forward direction being a discharge direction of the developer to allow said third conveyance member to be rotated at a second set speed that is faster than said first set speed by driving said second driving member in the case that the inclination angle detected by said inclination detecting means is not less than the upper limit of the reference range with an end portion on which the discharge port is formed located on the upper side; and that makes the rotation direction of said third conveyance member into a reverse direction in the case that the detected developer amount is not more than the lower limit of the reference range with an end portion on which the discharge port is formed located on the lower side.

7. An image forming device comprising the developing device according to claim 1.

8. A developing device comprising:

a developer container, which is elongated from one end to other end; which is divided into a first containing part and a second containing part that are communicated with each other at communication parts on the opposite end sides; which has a discharge port at one end side of the second containing part; and in which a developer including a toner and a carrier is contained;

a developer carrying member that carries the developer within said developer container to adhere it to an image carrying member;

a first conveyance member that is arranged in the first containing part of said developer container and conveys the contained developer while agitating it;

a second conveyance member that is arranged in the second containing part of said developer container, conveys the contained developer while agitating it, and supplies the developer to said developer carrying member;

a third conveyance member that is arranged between said second conveyance member and said discharge port;

a first driving member that rotary-drives said first conveyance member and said second conveyance member;

a second driving member that drives said third conveyance member so that its rotation direction can be changed;

inclination detecting means that detects the inclination of said developer container; and drive controlling means that makes the rotation direction of said third conveyance member into a forward direction being a discharge direction of the developer to allow said third conveyance member to be rotated at a first set speed by driving said second driving member in the case that the inclination angle detected by said inclination detecting means is within the reference range; that makes the rotation direction of said third conveyance member into a forward direction being a discharge direction of the developer to allow said third conveyance member to be rotated at a second set speed that is faster than said first set speed by driving said second driving member in the case that the inclination angle detected by said inclination detecting means is not less than the upper limit of the reference range with an end portion on which the discharge port is formed located on the upper side; and that makes the rotation direction of said third conveyance member into a reverse direction in the case that the detected developer amount is not more than the lower limit of the reference range with an end portion on which the discharge port is formed located on the lower side, wherein one of said communication parts is arranged in the vicinity of a region where said second conveyance member is close to said third conveyance member.

9. An image forming device comprising the developing device according to claim 2.

10. An image forming device comprising the developing device according to claim 3.

11. An image forming device comprising the developing device according to claim 4.

12. An image forming device comprising the developing device according to claim 5.

13. An image forming device comprising the developing device according to claim 6.

* * * * *